United States Patent [19]

Brower

[11] Patent Number: 4,843,642

[45] Date of Patent: Jul. 4, 1989

[54] COMBAT VEHICLE CREWMAN HELMET

[76] Inventor: Richard A. Brower, 657 Valley Steam Cir., Langhorn, Pa. 19047

[21] Appl. No.: 62,887

[22] Filed: Jun. 16, 1987

Related U.S. Application Data

[63] Continuation of Ser. No. 702,183, Feb. 15, 1985, abandoned.

[51] Int. Cl.[4] ..... A42B 3/00; A42B 1/08; A42B 1/22

[52] U.S. Cl. ..... 2/6; 2/414; 2/419; 2/423

[58] Field of Search ..... 2/423, 6, 411, 414, 2/415, 416, 417, 418, 424, 425, 183, 420

[56] References Cited

U.S. PATENT DOCUMENTS

| | | | |
|---|---|---|---|
| 1,602,727 | 10/1926 | Turner | 2/414 |
| 3,005,203 | 10/1961 | Aileo | 2/423 |
| 3,082,428 | 3/1963 | Zbikowski | 2/418 |
| 3,153,792 | 10/1964 | Marietta | 2/414 |
| 3,190,973 | 6/1965 | Aileo | 2/423 |
| 3,197,784 | 8/1965 | Carlisle | 2/420 |
| 3,470,564 | 10/1969 | Aileo | 2/423 |
| 3,513,482 | 2/1970 | Holden | 2/425 |
| 3,541,611 | 11/1970 | Begvin | 2/423 |
| 3,596,288 | 8/1971 | Marchello | 2/425 |
| 3,786,519 | 1/1974 | Aileo | 2/415 |
| 3,943,572 | 3/1976 | Aileo | 2/415 |
| 4,443,891 | 4/1984 | Blomgren et al. | 2/425 |
| 4,516,274 | 5/1985 | Buckland | 2/423 |

FOREIGN PATENT DOCUMENTS

| | | | |
|---|---|---|---|
| 2324686 | 12/1973 | Fed. Rep. of Germany | 2/423 |
| 996612 | 1/1954 | France | 2/418 |
| 524059 | 7/1940 | United Kingdom | 2/423 |

*Primary Examiner*—Wm. Carter Reynolds
*Attorney, Agent, or Firm*—Ratner & Prestia

[57] ABSTRACT

A flexible helmet for armored vehicle crewmen which has a plurality of adjustable straps which position ear shells and ear seals and a unitary impact-absorbing pad which forms a virtually continuous layer of protection while conforming to the head of the wearer.

13 Claims, 3 Drawing Sheets

COMBAT VEHICLE CREWMAN HELMET

This application is a continuation of application Ser. No. 702,183, filed 2/15/85, now abandoned.

FIELD OF THE INVENTION

This invention relates generally to the field of protective helmets and particularly to helmets for use by crewmen of combat vehicles. Such helmets are generally designed to protect the head of a vehicle crewman from damage due to impacts. Additionally, such helmets are commonly intended to protect the wearer from high levels of ambient noise present in such vehicles.

BACKGROUND OF THE INVENTION

Persons working in areas of high ambient noise are commonly provided with sound attenuating equipment in order to protect their hearing. In addition, when such personnel are required to communicate with others in the performance of their duties such sound attenuation equipment is commonly combined with electronic earphones and microphones for permitting two-way voice communication. In environments where impact is not a serious threat, such sound attenuation equipment commonly comprises a pair of ear shells containing earphones supported on the wearer's head by a resilient band extending across the top of the wearer's head. Additionally, a boom microphone is commonly supported on the external surface of one of these ear shells. Typical of such a headphone is the headset manufactured by the David Clark company and sold under various model numbers including H-3330. In environments where impact to the head are a serious danger, sound attenuation equipment may be combined with a helmet structure. Typical of such a helmet is the David Clark company helmet conforming to MIL-H-81735(AS). In that helmet, a cloth cap is fitted with resilient energy-absorbing pads and rigid plastic shells in order to protect the wearer's head from impact. The transverse band joining the two ear shells is secured to the fabric cap by a fabric channel which is snapped in place to surround the band.

Another common approach to the provision of sound attenuation and impact protection for personnel is the incorporation of sound attenuating ear shells within an impact resistant soft helmet such as that exemplified by U.S. Pat. Nos. 3,789,427, 3,786,519 and 3,784,984. In these helmets, a helmet comprised of a fabric mesh which is formed into individual pockets, is provided with a plurality of discreet energy absorbing pads. These pads are inserted into the helmet's pockets in order to provide impact resistance. The helmet structure also contains apertures for the insertion of sound attenuating ear shells containing earphones. Such an aperture in a soft fabric shell helmet is shown in U.S. Pat. No. 3,005,203 as well as numerous other patents including U.S. Pat. No. 3,190,973.

Other methods of securing ear shells to helmet assemblies or to helmet rigging include the use of several straps which are secured to both the ear shell and helmet or rigging. Typical of such a method are U.S. Pat. Nos. 3,335,720 (FIG. 1 - elements 15, 16) and 3,190,973 (FIG. 6 - elements 163). These attachment means, however, fail to provide full freedom of adjustment of the ear shells relative to the wearer's ears. Such adjustment is provided in those patents by conventional sizing of the entire helmet shell.

Prior art sound attenuation and impact resistant helmets of the type discussed above provide reasonable levels of both sound attenuation and resistance. However, prior art designs have severe shortcomings which render them less than entirely satisfactory in use.

SUMMARY OF THE INVENTION

The present invention seeks to remedy deficiencies in both sound attenuation characteristics and impact resistance characteristics which are prevalent in prior art combat vehicle crewman helmets. Such deficiencies include leakage of ambient noise into the ear shells due to imperfect sealing of the ear shell against the wearer's head as well as reduced impact resisting capabilities in regions where adjacent separate energy absorbing pads abut.

The present invention comprises a flexible fabric helmet with an impact absorbing pad structure of resilient material and ear shells characterized by a high degree of sound attenuation and impact resistance effectiveness.

An important aspect of the present invention is the provision of multipoint adjustment means for optimum positioning in all directions of the sound attenuating ear shells independent of the dimensions of the supporting fabric helmet and the configuration or conformation of the pad structure associated therewith. In this way, sound attenuation is improved. Furthermore, optimal positioning of the ear shells permits the use of ear shells having smaller ear apertures.

Preferably, the helmet of the present invention includes a one-piece "lobster pad" which is adapted to conform to the shape of the wearer's head without interfering with ear shell positioning. Impact resistance is provided by this one-piece pad over the entire region of the wearer's head within the wearer's hairline.

DETAILED DESCRIPTION OF THE INVENTION

Figure 1:
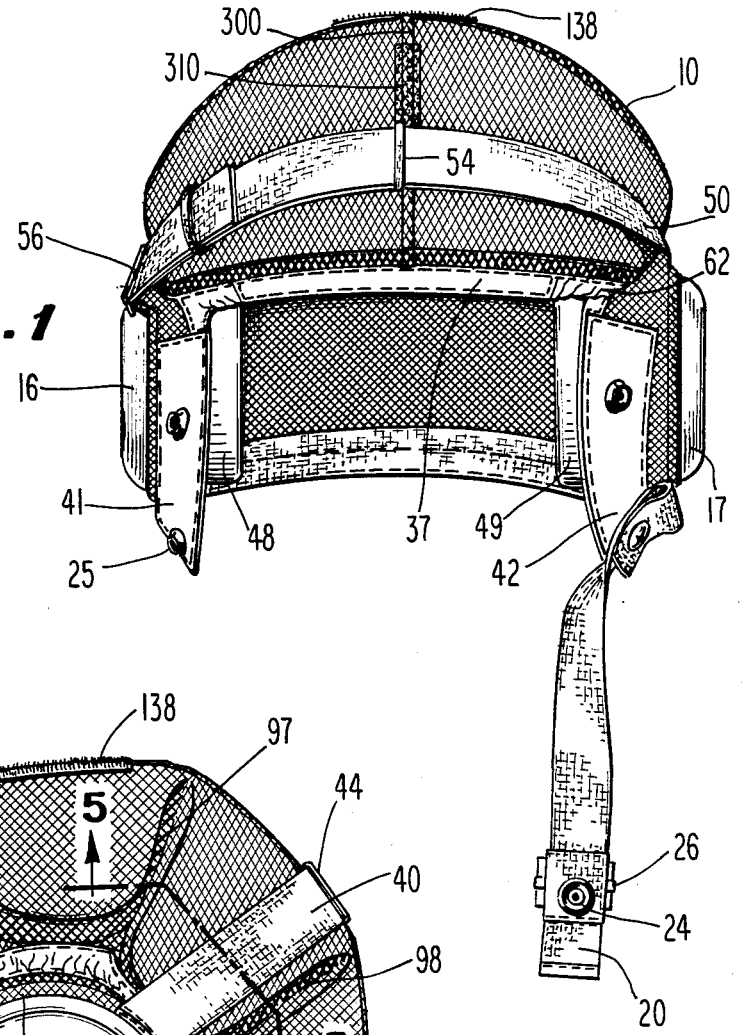
FIG. 1 is a front elevational view of the helmet of the present invention.

Referring now to the figures wherein like structures are denoted with like reference characters, there is shown a combat vehicle crewman's helmet including a soft flexible shell 10, an energy absorbing pad 12, right and left sound attenuating ear shells 16 and 17 having respective ear seals 48 and 49, and external adjustment straps including chin strap 30, nape strap 30, crown strap 40, and brow strap 50.

Referring now to FIG. 1, there is shown a front elevational view of the helmet comprising the present invention. The yieldable fabric shell 10 is constructed with a central opening (shown closed) which extends longitudinally from the brow to the nape along the center line of top surface of the helmet. This opening is secured in a closed position by small areas of attached hook type releasable fastening material 310, 138 and 314. Traversing the helmet structure laterally from ear shell to ear shell are three adjustment straps. The nape strap 30 extends from the lower rear quadrant of each ear shell across the nape region of the wearer's head. The crown strap 40 extends from the upper rear quadrant of each ear shell and generally traverses the crown of the wearer's head while the brow strap 50 emanates from the upper forward quadrant of each ear shell and traverses the brow of the wearer. The crown strap is retained in position at the crown of the wearer's head by strap retaining loop 34 while the brow strap is retained in position by strap retaining loop 54.

Figure 2:
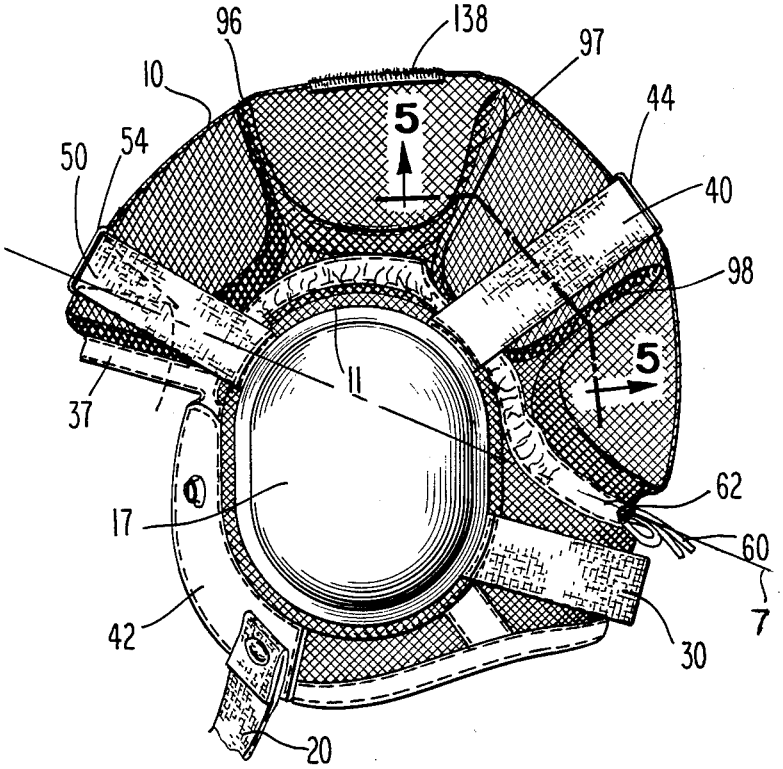
FIG. 2 is a left side elevational view of the helmet of the present invention.

As shown in FIGS. 1, 2, in the preferred form of the present invention, fabric shell 10 is also provided with left and right fabric channels 62 which generally follow the contour of the wearer's hairline and extend from the wearer's temple toward the rear of the wearer's head. Contained within fabric channels 62 are a pair of adjustment cords 60 which are secured at their forward ends to brow tape 37 and may be adjustably secured to each other at the rear of the helmet. Adjustment cords 60 are adapted to adjust the circumference of shell 10 in a plane 7 generally extending from the brow to the occipital region of the wearer's head to enhance the fit of the helmet and therefore its sound attenuation properties. The forward lower quadrant of each ear shell region is fitted with a panel of material which is more rigid than the material constituting fabric helmet shell 10. For instance, these panels 41 and 42 may be fabricated of leather and securely stiched to fabric shell 10. Left side panel 42 additionally provides a point of attachment for chin strap 20.

Chin strap 20 originates at left side panel 42 and is provided at its distal end with an adjustment means 26 and a snap fitting 24 which engages snap fitting 25 on helmet panel 41 when the helmet is donned and secured on the wearer's head.

Figure 3:
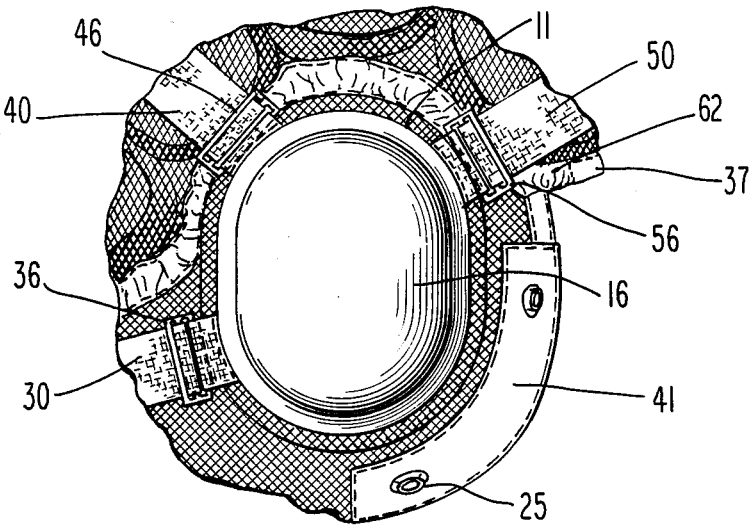
FIG. 3 is a partial right side elevational view of the ear shell region of the helmet of the present invention.
Figure 4:
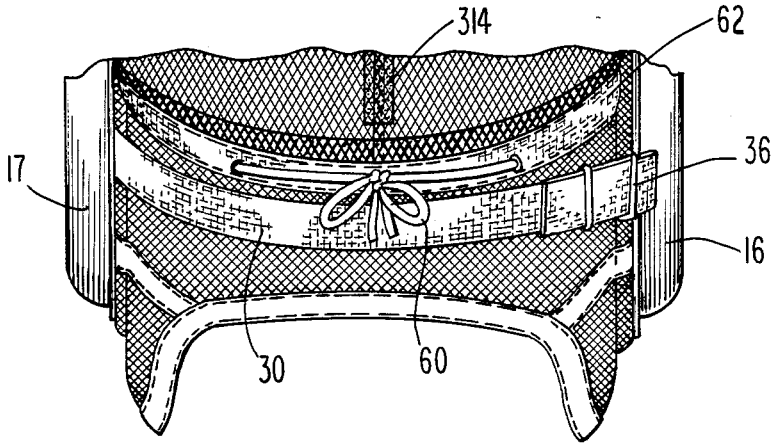
FIG. 4 is a partial rear elevational view of the helmet of the present invention.

Referring now to FIG. 3, there are shown the adjustment means provided for straps 30, 40, and 50. In the region of the periphery of ear shell 16, there are provided three fabric tabs each carrying a buckle. In another embodiment, ear shell 17 may be provided with fabric tabs and buckles similar to those associated with ear shell 16. Brow strap 50 is connected to its buckle 56 which is in turn connected to a tab secured to helmet fabric shell 10 immediately adjacent to the upper front quadrant of ear shell 16. Similarly, crown strap 40 is adjustably secured to buckle 46 in the upper rear quadrant and nape strap 30 is adjustably secured to buckle 36 in the lower rear quadrant. Adjustment of straps 30, 40, and 50, in cooperation with chin strap 20 when secured to snap 25 provides a means for accurately positioning ear shells 16 and 17 with respect to the wearer's ears. Further, the panel of fabric 11 attached between fabric channels 62 and ear shells 16 and 17 permits adjustment of ear shell position independent of helmet position on the wearer's head. When properly adjusted, straps 20, 30, 40, and 50 not only position ear shells 16 and 17 with respect to the wearer's ears, but also bias ear shells 16 and 17 with their respective ear seals 48 and 49 into sound excluding contact with the area of the wearer's head peripheral to the wearer's ears. Again, such biasing function is performed independent of the helmet fabric shell 10 or pad 12.

Figure 5:
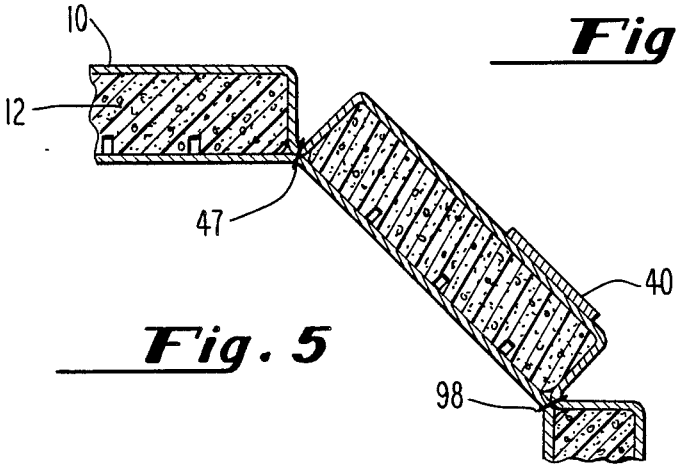
FIG. 5 is a partial cross-sectional view taken at plane 5 as indicated in FIG. 2.
Figure 6:
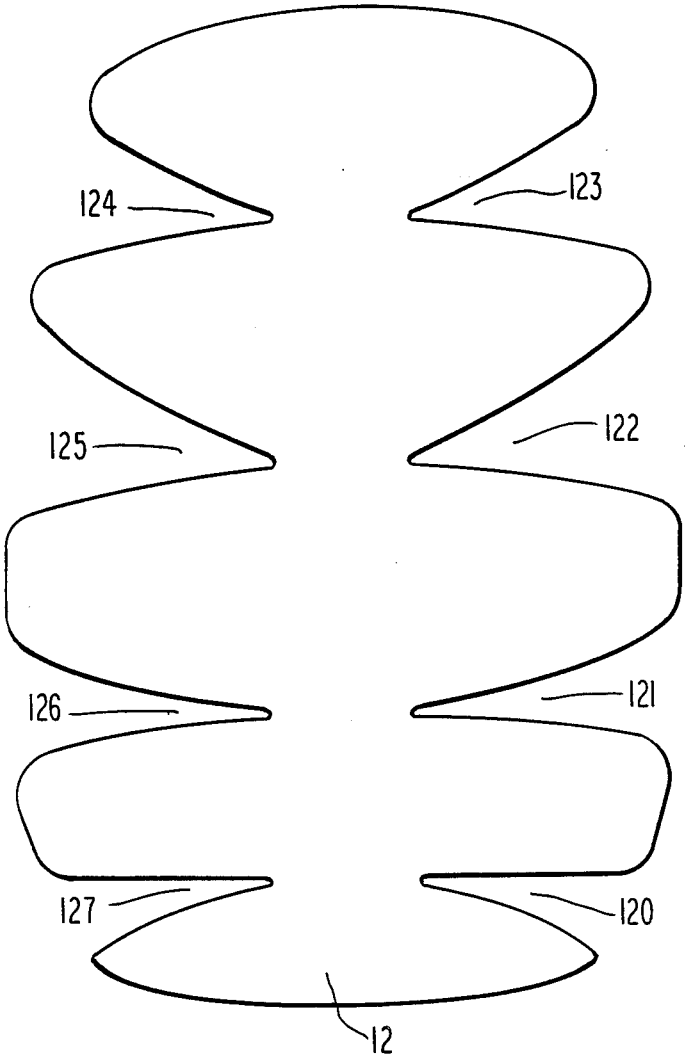
FIG. 6 is a plan view of the lobster pad of the present invention.

Referring now to FIG. 5 there is shown a cross-section of the helmet of the present invention taken at plane 5 as denominated in FIG. 2. As depicted in FIG. 5, the interconnected channels formed by a stitching together of the two fabric panels comprising helmet fabric shell 10 are shown as stitching lines 97 and 98. As depicted in FIG. 2, stitching lines 97 and 98 extend from fabric channel 62 toward the central opening for some distance but never reach central opening.

In its preferred form, the pad structure of this invention comprises a one-piece lobster pad 12 which is formed of a single piece of energy absorbing material cut with lateral indentations to permit it to assume the shape of the wearer's head. Stitching lines 97 and 98 as well as 95 and 96 engage corresponding lateral indentations in lobster pad 12 and retain it in place within fabric shell 10. It will be appreciated that stitching lines 95, 96, 97, and 98 each have left and right halves which emanate from the peripheral channels 62 and extend toward central opening. Each of these stitch lines engages a respective lateral indentation in lobster pad 12. These lateral indentations in lobster pad 12 according to the relations depicted in Table I.

TABLE I

| Stitch Line | Left Indentation | Right Indentation |
|---|---|---|
| 95 | 127 | 120 |
| 96 | 126 | 121 |
| 97 | 125 | 122 |
| 98 | 124 | 123 |

When the helmet of the present invention is donned by a wearer, and adjustment straps 20, 30, 40 and 50 are tightened to provide a proper positioning of the ear shells and contact of the ear seals with the user's head peripheral to his ears and when adjustment cord 60 is properly tensioned, the assembly provides superior sound attenuation to similar prior art device. When tested in accordance with ANSI Z24.22 1957, sound attenuations over the range 150 to 8,000 Hz are a minimum of 3 dB improved over that required in MIL-H-44117 (12/27/83). At higher frequencies, (above 4000 Hz) attenuations are improved by more than 10 dB.

As will be appreciated by those skilled in the art, the unique configuration of lateral indentations in the unitary energy absorbing pad employed in the preferred form of the present invention are the means by which pad 12 is permitted to assume the hemispherical shape of the wearer's head. Apart from the avoidance of awkwardness and inconvenience associated with prior art multi-pad structures, an important advantage of the lobster pad is that radial forces upon a side portion of the energy absorbing pad will tend to cause a higher degree of edge abutment between adjacent portions of the energy absorbing pad. Unlike the helmet designs of the prior art which incorporated a plurality of discreet pads which were relatively movable with respect to each other, the use of a unitary pad having lateral indentations causes better impact absorbing performance. A radial impact upon any section of the pad will be distributed across the pad by tending to push adjacent lateral portions of pad 12 together, (those portions already being of unitary construction) and tends to cause the pad to conform more closely to the wearer's head, upon receiving such an impact, thereby providing added protection.

It should be noted that fabric shell 10 is deliberately configured to leave some flexible helmet space 11 between the ear shells and the pad structure so as not to interfere with optimum ear shell positioning.

Finally, because of the use of independent positioning and adjustment means in addition to the fabric shell of the present helmet, a wider range of head shapes and sizes may be accommodated with a single helmet design. Unlike prior art helmets in which the vertical and horizontal positioning of the ear shells depended upon the dimensions of the wearer's head and the relative dimensions of the helmet's pad structure adjacent thereto, the helmet of the present invention provides for fully adjustable and independent location of ear shell apertures over the wearer's ears without regard for the size or shape of the wearer's head.

While the highly desirable attributes of helmets made in accordance with this invention are best realized in a helmet which incorporates all of the preferred features described, it should be understood that some of these attributes may also be realized in non-preferred embodiments of this invention. For example, a helmet with enhanced sound attenuation (by better ear shell positioning) may include a multiple-strap ear shell adjustment system as described above, in combination with a multiple pad structure of the type shown in U.S. Pat. Nos. 3,784,984, 3,786,519, and 3,789,427 provided of course the pad structure of that design is configured to leave some flexible free fabric space between the ear shell periphery and the adjoining pad structure periphery.

Having described the helmet of the present invention with regard to specific embodiments, it will nonetheless be understood by those skilled in the art of helmet design and construction that the concepts emobodied herein may be achieved in a variety of embodiments without departing from the true spirit and scope of the invention. It is intended, therefore, that the appended claims not be limited to the specific embodiments illustrated and described herein but rather should be extended to all such variants and embodiment thereof which are within the true spiritual scope of this invention.

I claim as my invention:

1. A soft helmet comprising:

a shell of yieldable material;

a generally oblong, unitary head-covering pad of resilient, energy-absorbing material fitted within and secured to said yieldable shell conforming to the head of a wearer and oriented to extend from the brow to the wearer to the back of the head of the wearer, said pad sized to cover the brow of the wearer and the top, sides and back of the head of the wearer and having a plurality of lateral indentations in each of its longer sides with the adjacent edges of each of said indentations abutting one another;

a pair of ear shells secured to said yieldable shell at opposite lateral sides thereof;

ear seals on said ear shells;

and adjustable tensioning means for positioning said ear shells centrally over the ears of the wearer while biasing said ear seals against the head of the wearer in surrounding relation to the ears of the wearer.

2. The helmet of claim 1 wherein said pad includes at least four lateral indentations in each of its longer sides.

3. The helmet of claim 1 wherein the central, unindented region of said pad is adapted to protect the crown of the wearer's head from impacts.

4. The helmet of claim 3 wherein said indented lateral regions of said pad are adapted to protect the sides of the wearer's head from impacts.

5. The helmet of claim 4 wherein said pad has front and rear unindented regions adapted to protect the brow and occipital regions of the wearer's head, respectively, from impacts.

6. The helmet of claim 1 wherein said tensioning means comprises at least three adjustable straps extending circumferentially about the wearer's head on the outside of said shell, from the region adjacent the left ear shell, to the region adjacent the right ear shell.

7. The helmet of claim 6 wherein said plurality of said straps includes a releaseably securable adjustable chinstrap.

8. The helmet of claim 6 wherein said plurality of said straps includes a nape strap.

9. The helmet of claim 6 wherein said plurality of said straps includes a brow strap.

10. The helmet of claim 6 wherein said plurality of said straps includes a crown strap.

11. The helmet of claim 1 further comprising a sizing means adapted to adjust the circumference of said yieldable shell in a plane generally extending from the brow to the occipital region of the wearer's head.

12. The helmet of claim 11 wherein said sizing means comprises a draw cord situated in a channel disposed on the surface of said yieldable shell.

13. The helmet of claim 12 wherein said draw cord is discontinuous across the brow region of the wearer's head.

* * * * *